US011826764B2

(12) United States Patent
Grebing

(10) Patent No.: US 11,826,764 B2
(45) Date of Patent: Nov. 28, 2023

(54) ADAPTER FRAME, ASSEMBLY, AND SUCTION UNIT

(71) Applicant: FESTOOL GMBH, Wendlingen (DE)

(72) Inventor: Gerhard Grebing, Nurtingen (DE)

(73) Assignee: FESTOOL GMBH, Wendlingen (DE)

( * ) Notice: Subject to any disclaimer, the term of this patent is extended or adjusted under 35 U.S.C. 154(b) by 0 days.

(21) Appl. No.: 17/697,535

(22) Filed: Mar. 17, 2022

(65) Prior Publication Data

US 2022/0203383 A1 Jun. 30, 2022

Related U.S. Application Data

(62) Division of application No. 16/603,314, filed as application No. PCT/EP2017/058690 on Apr. 11, 2017.

(51) Int. Cl.
*A47L 9/00* (2006.01)
*B04C 11/00* (2006.01)
(Continued)

(52) U.S. Cl.
CPC ..... *B04C 11/00* (2013.01); *A47L 7/0095* (2013.01); *A47L 9/009* (2013.01); *A47L 9/1683* (2013.01); *A47L 9/1691* (2013.01); *B04C 5/185* (2013.01)

(58) Field of Classification Search
CPC ..... B04C 11/00; B04C 5/185; A47L 7/0095; A47L 9/009; A47L 9/1683; A47L 9/1691
See application file for complete search history.

(56) References Cited

U.S. PATENT DOCUMENTS 1,923,689 A * 8/1933 Rosenberg ..... A47L 11/4044 291/1
2,819,485 A * 1/1958 Sparklin ..... A47L 9/009 211/13.1

(Continued)

FOREIGN PATENT DOCUMENTS

CN 1705451 12/2005
CN 101068661 11/2007

(Continued)

OTHER PUBLICATIONS

International Search Report in corresponding PCT/EP2017/058690, dated Jan. 9, 2018.

(Continued)

*Primary Examiner* — Dung H Bui
(74) *Attorney, Agent, or Firm* — Hamre, Schumann, Mueller & Larson, P.C.

(57) ABSTRACT

An adapter frame for mounting onto a base, in particular a suction device, a system box and/or a roller board, and for receiving a particle collecting container for a cyclone pre-separator, where the adapter frame includes a rectangular underside and adapter frame peripheral walls extending upwards from the underside, and lower adapter frame couplers, designed to provide a releasable, vertically tension-proof coupling to the base when the adapter frame is positioned on the base. The adapter frame on its upper side has a container receptacle for receiving the particle collecting container, the horizontal inner contour of which tapers towards the underside, so that the container receptacle is able to receive and horizontally stabilise a particle collecting container having an outer contour tapering downwards.

15 Claims, 5 Drawing Sheets

(51) Int. Cl.

| | |
|---|---|
| ***A47L 7/00*** | (2006.01) |
| ***A47L 9/16*** | (2006.01) |
| ***B04C 5/185*** | (2006.01) |

(56) References Cited

U.S. PATENT DOCUMENTS 3,063,082 A * 11/1962 Rosenberg ..... A47L 11/4058 15/327.2
D213,639 S * 3/1969 Fegan ..... D32/21
3,570,222 A * 3/1971 Dudek ..... A47L 9/122 55/504
4,036,346 A * 7/1977 Livingston ..... A47L 9/22 15/327.6
4,809,396 A * 3/1989 Houser ..... A47L 11/4061 15/353
4,934,017 A * 6/1990 Kent ..... A47L 5/225 15/328
D318,155 S * 7/1991 Goodrich ..... D32/24
D343,706 S * 1/1994 Gurstein ..... D32/22
6,176,559 B1 * 1/2001 Tiramani ..... B65H 75/403 280/47.35
6,183,527 B1 * 2/2001 O'Banion ..... B23D 59/006 55/439
D525,000 S * 7/2006 Williams ..... D32/15
8,677,661 B2 * 3/2014 Michels ..... B25H 3/02 40/313
D701,697 S * 4/2014 Sabbag ..... D3/905
8,756,756 B2 * 6/2014 Theising ..... A47L 11/4055 15/354
9,375,835 B1 * 6/2016 Lin ..... B25H 3/00
9,725,209 B1 * 8/2017 Ben-Gigi ..... B25H 3/021
RE47,022 E * 9/2018 Sosnovsky ..... B65D 45/22
D828,671 S * 9/2018 Cope ..... D34/23
10,131,043 B2 * 11/2018 Mergener ..... B25B 23/1475
10,286,542 B2 * 5/2019 Wolle ..... B25H 3/06
10,786,131 B2 * 9/2020 Robinson ..... A47L 11/30
D919,913 S * 5/2021 Grebing ..... D32/31
2003/0038142 A1 * 2/2003 Gee ..... B65D 43/166 220/4.24
2009/0223188 A1 * 9/2009 Oh ..... A47L 9/1691 55/365
2009/0288970 A1 * 11/2009 Katz ..... B25H 3/00 220/252
2010/0017998 A1 * 1/2010 McCambridge ..... B62B 3/004 15/347
2010/0139032 A1 * 6/2010 Tomasiak ..... A47L 7/0042 29/402.01
2010/0154367 A1 * 6/2010 Luo ..... A47L 5/362 55/456
2011/0107547 A1 * 5/2011 Liu ..... A47L 9/0009 15/323
2011/0181008 A1 * 7/2011 Bensman ..... B25H 3/02 220/660
2011/0233096 A1 * 9/2011 Michels ..... B65D 25/205 206/459.5
2012/0180250 A1 * 7/2012 Ricklefsen ..... A47L 9/0009 15/300.1
2012/0326406 A1 * 12/2012 Lifshitz ..... B25H 3/02 206/503
2013/0031731 A1 * 2/2013 Hess ..... A47L 9/00 15/3
2014/0373306 A1 * 12/2014 Tomasiak ..... A47L 9/127 29/402.04
2015/0274362 A1 * 10/2015 Christopher ..... B65D 21/0219 206/506
2015/0313433 A1 11/2015 Ruffo
2016/0008972 A1 * 1/2016 Chen ..... B25H 3/02 206/373
2017/0129097 A1 * 5/2017 Engvall ..... A45C 11/20
2017/0158216 A1 * 6/2017 Yahav ..... B62B 5/0013
2017/0165828 A1 * 6/2017 Fleischmann ..... B65D 85/00
2017/0190472 A1 * 7/2017 Milburn ..... B25H 3/02
2017/0259956 A1 * 9/2017 Hori ..... A45C 13/02
2018/0044059 A1 * 2/2018 Brunner ..... B65D 21/0228
2018/0200876 A1 * 7/2018 Wolle ..... B25H 3/02
2018/0290288 A1 * 10/2018 Brunner ..... B25H 3/02
2019/0001482 A1 * 1/2019 Wolle ..... B25H 3/02
2019/0002004 A1 * 1/2019 Brunner ..... B65D 21/0212
2019/0207339 A1 * 7/2019 Suzuki ..... G05F 1/445
2019/0380549 A1 * 12/2019 Liu ..... A47L 9/2884
2020/0023383 A1 * 1/2020 Grebing ..... B04C 5/185
2020/0047265 A1 * 2/2020 Ender ..... B23D 47/025
2020/0069126 A1 * 3/2020 Mantes ..... A47L 9/248
2020/0196814 A1 * 6/2020 Grebing ..... A47L 9/1608
2021/0114043 A1 * 4/2021 Grebing ..... A47L 7/0095
2021/0274989 A1 * 9/2021 Grebing ..... B65D 25/282

FOREIGN PATENT DOCUMENTS

CN 102834035 12/2012
EP 2 829 209 1/2015
EP 2829212 A1 * 1/2015 ..... A47L 7/0095
EP 3 141 353 3/2017
EP 3232891 B1 * 3/2022 ..... A47L 7/0095
GB 2088705 A * 6/1982 ..... A47L 9/009
JP 2013226622 A * 11/2013 ..... B25H 3/02
WO 98/35602 8/1998
WO WO-9835602 A1 * 8/1998 ..... A47L 5/365
WO WO-2016008860 A1 * 1/2016 ..... B25H 3/02

OTHER PUBLICATIONS

Written Opinion in corresponding PCT/EP2017/058690, dated Jan. 9, 2018.
"Ultimate Dust Deputy Kit" by "Oneida air Systems" https://www.oneida-air.com/ultimate-dust-deputy-cyclone-kit-fesetool-vacs, downloaded Aug. 16, 2019.
Chinese Search Report in corresponding Chinese Application No. 2017800895418, dated Nov. 9, 2020.
Chinese Office Action in corresponding Chinese Application No. 2017800895418, dated Nov. 17, 2020.

* cited by examiner

ADAPTER FRAME, ASSEMBLY, AND SUCTION UNIT

This application is a Divisional of U.S. patent application Ser. No. 16/603,314 filed Oct. 7, 2019, which is a US National Stage application based on PCT/EP2017/058690 filed Apr. 11, 2017, which applications are incorporated herein by reference.

The invention relates to an adapter frame for mounting onto a base, in particular onto a suction device, a system box and/or a roller board, and for receiving a particle collecting container for a cyclone pre-separator

BACKGROUND OF THE INVENTION

A cyclone pre-separator is typically operated as a separating preliminary stage of a suction device. The cyclone pre-separator is positioned on a particle collecting container and connected to the suction device, so that the airflow sucked in by the suction device first passes through the cyclone pre-separator and then the suction device. The cyclone pre-separator eliminates a majority of the particles contained in the airflow and outputs them to the particle collecting container where the particles are collected. Consequently, fewer particles are transported to the suction device. This is a particular advantage if the suction device has a bag and/or filter, by which particles are separated and which has to be changed when a particular fill level/degree of soiling is reached.

Cyclone pre-separators are in particular used in the manual crafts sector, where they are operated as a separating preliminary stage of the bag suction devices commonly used there.

By way of example, the company "Oneida AirSystems" offers a set comprising a cyclone pre-separator and a particle collecting container under the product name "Ultimate Dust Deputy". The particle collecting container has a substantially cuboid basic design and can be positioned on the upper side of said suction devices common in the manual crafts sector. On the upper side of the particle collecting container a cover can be positioned, on which a cyclone pre-separator can be placed. The particle collecting container is intended to accept a plastic bag in which the particles separated by the cyclone pre-separator are collected.

SUMMARY OF THE INVENTION

An object of the invention is to provide the possibility for said suction devices to use easier-to-handle particle collecting containers.

The object is achieved by an adapter frame for attaching to a base, in particular a suction device, a system box and/or a roller board, and for receiving a particle collecting container for a cyclone pre-separator. The adapter frame comprises a rectangular underside and adapter frame peripheral walls extending upwards from the underside. The adapter frame also comprises lower adapter frame couplers, designed to provide a releasable, vertically tension-proof coupling with the base, when the adapter frame is positioned on the base. On its upper side the adapter frame has a container receptacle for receiving the particle collecting container. The horizontal inner contour of the container receptacle tapers towards the underside, so that the container receptacle is able to receive a particle collecting container with an outer contour tapering downwards and to stabilise such a particle collecting container horizontally.

Through said adapter frame it is possible to place a particle collecting container with an outer contour tapering downwards—thus a particle collecting container that can be stacked in an identical particle collecting container—horizontally stabilised on a base, in particular a suction device. Consequently particle collecting containers that can be interstacked—and are thus easier to handle—can also be used.

The described form of the container receptacle—namely that the horizontal inner contour defined by the container peripheral walls tapers downwards towards the underside—is also referred to in the following as "conical". The shape of a particle collecting container with its outer contour tapering towards its underside is similarly referred to as "conical". Preferably with the container receptacle and/or the particle collecting container, the taper is constant and/or extends as far as the underside of the container receptacle or as far as the container bottom and/or occurs over the full vertical extension of the container receptacle or of the particle collecting container.

The expression "releasable coupling" in particular means a coupling that can be created and released without tools and reversibly, by way of example a coupling involving a manually operable rotary latch or a manually operable locking lug. The expression "vertically tension-proof coupling" is intended in particular to mean a coupling which transmits force vertically. Expediently a "vertically tension-proof coupling" is a coupling, which is tension-proof in a plurality of, preferably in all, spatial directions and/or remains stable during transfer of force.

Advantageous embodiments are the subject matter of the dependent claims.

Exemplarily the length of the underside of the adapter frame is between 350 mm and 450 mm. Preferably the width of the underside of the adapter frame is between 250 mm and 350 mm. In particular the length of the underside of the adapter frame is 396 mm and the width of the underside of the adapter frame is 296 mm. An adapter frame with such dimensions is suitable for the suction devices common in the manual crafts sector.

Preferably the inner contour of the container receptacle tapers continuously. Preferably the inner contour of the container receptacle tapers continuously over the vertical extension, preferably the full vertical extension, of the container receptacle. A container receptacle with such a design is particularly well-suited to receiving a particle collecting container that can be stacked in an identical particle collecting container.

Preferably the container receptacle on its upper side accounts for at least 60% of the base area of the adapter frame. In particular the container receptacle on its upper side accounts for at least 70% or at least 80% of the base area of the adapter frame. Through such a design of the container receptacle an efficient use of the available base area is achieved.

Preferably all inner sides of the container receptacle contribute to the taper. Consequently the container receptacle is suitable for receiving a correspondingly designed particle collecting container, in particular a particle collecting container the container peripheral walls of which together form the shape of a truncated upside down pyramid periphery.

Preferably the adapter frame has upper adapter frame couplers, designed to provide a releasable, vertically tension-proof coupling with the cyclone pre-separator, when the cyclone pre-separator is positioned on the adapter frame. The adapter frame couplers make it possible to attach the cyclone pre-separator directly to the adapter frame. Consequently the cyclone pre-separator and the adapter frame can be transported together in a practical manner.

Preferably the lower adapter frame couplers have first lower adapter frame couplers and second lower adapter frame couplers. Expediently each of the first lower adapter frame couplers and the second lower adapter frame couplers is compatible with a different coupling system. In particular each of the first lower adapter frame couplers and the second lower adapter frame couplers is designed to provide a releasable, vertically tension-proof coupling to the base. In particular in the manual crafts sector various coupling systems are widely used which serve to couple system boxes together and/or with a base, such as a suction device or a roller board. Due to the fact that a first and a second lower adapter frame couplers are present, each of which is compatible with a different coupling system—and which thus differ from each other and in particular are not compatible with each other—the adapter frame is compatible with two different coupling systems and is therefore highly versatile.

Preferably the adapter frame has a top edge, which protrudes vertically upwards beyond the container receptacle. The upper edge surrounds the container receptacle and is displaced horizontally inwards in relation to the outer contour of the underside of the adapter frame. An upper edge designed in this way can in particular be configured to correspond with the upper edge of a particle collecting container, and thereby allow a cyclone pre-separator to be placed on the adapter frame in the same way as on a particle collecting container.

Preferably the adapter frame has operable clamping means, designed to clamp, in the container receptacle, a particle collecting container inserted in the container receptacle. The clamping means allow a particularly good horizontal and/or vertical securing of the particle collecting container in the adapter frame.

The invention also relates to an assembly comprising an adapter frame according to any one of the embodiments described above and a box-shaped cyclone pre-separator. Expediently the adapter frame has upper adapter frame couplers and the cyclone pre-separator expediently has lower housing couplers. The upper adapter frame couplers and the lower housing couplers are designed to provide a releasable, vertically tension-proof coupling between the adapter frame and the cyclone pre-separator when the cyclone pre-separator is positioned on the adapter frame. When the cyclone pre-separator is positioned on the adapter frame and coupled to the latter, the cyclone pre-separator and the adapter frame can be particularly easily transported and/or stowed together.

Preferably the adapter frame further has lower adapter frame couplers and the cyclone pre-separator has upper housing couplers. The lower adapter frame couplers and the upper housing couplers are designed to provide a releasable, vertically tension-proof coupling between the adapter frame and the cyclone pre-separator when the adapter frame is positioned on the cyclone pre-separator. Therefore, an assembly, in which a cyclone pre-separator is positioned on an adapter frame, can be coupled to itself and can therefore be used in a very practical manner like a system box in a compatible coupling system.

Preferably the assembly also comprises a particle collecting container. The particle collecting container in particular has container couplers, configured to provide a releasable, vertically tension-proof coupling with the lower housing couplers when the cyclone pre-separator is positioned on the particle collecting container. Thus, the lower housing couplers of the cyclone pre-separator serve two purposes—firstly, coupling to the adapter frame (e.g. during transport) and secondly coupling to the particle collecting container (e.g. during operation).

The invention further relates to a suction unit comprising a suction device with suction device couplers and an adapter frame according to any one of the embodiments discussed above. The adapter frame has lower adapter frame couplers and is positioned on the upper side of the suction device. The lower adapter frame couplers and the suction device couplers provide a coupling, in particular a releasable, vertically tension-proof coupling.

The invention further relates to an assembly comprising the suction device and a particle collecting container inserted in the container receptacle, and a cyclone pre-separator positioned on the particle collecting container.

The invention further relates to an assembly comprising a roller board with roller board couplers and an adapter frame according to any one of the embodiments discussed above positioned on the roller board. The roller board couplers are coupled with the lower adapter frame couplers and provide in particular a releasable, vertically tension-proof coupling.

Example embodiments are described below by reference to the drawing.

DETAILED DESCRIPTION OF THE INVENTION

Figure 1:
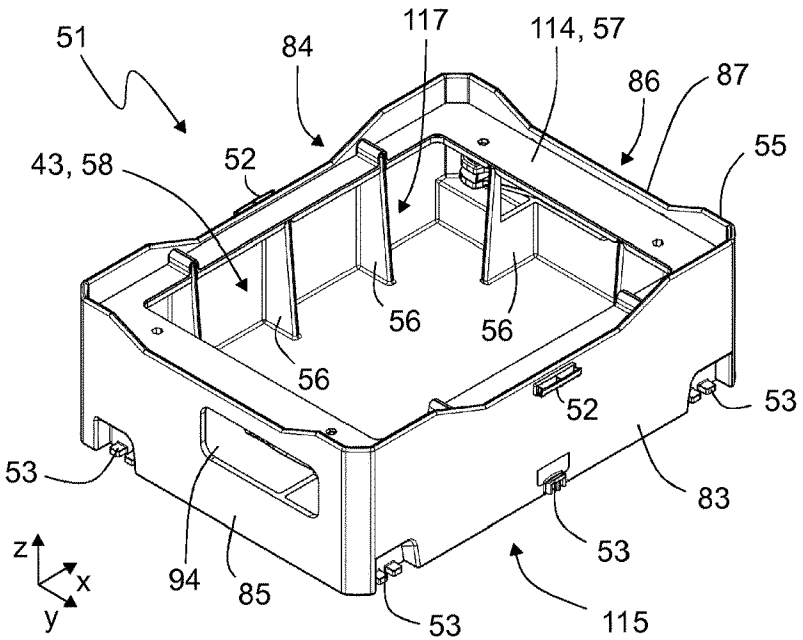
FIG. 1 shows an adapter frame from above.

As shown in FIG. 1, the adapter frame 51 extends in a vertical direction, running parallel to the indicated z-axis, in a longitudinal direction, running parallel to the indicated x-axis, and in a transverse direction, running parallel to the indicated y-axis. The x-axis, y-axis and z-axis are aligned orthogonally to each other.

The adapter frame 51 is used for attaching to a base, by way of example a suction device 79, a system box and/or a roller board 118. The adapter frame 51 also serves to receive a particle collecting container 2 for a cyclone pre-separator 1. The adapter frame 51 has a rectangular underside 115 and has adapter frame peripheral walls 83, 84, 85, 86 extending upwards from the underside 115. The adapter frame 51 also comprises lower adapter frame couplers 53, designed to provide a releasable, vertically tension-proof coupling with the base, when the adapter frame 51 is positioned on the base. On its upper side 114 the adapter frame 51 has a container receptacle 43 for receiving the particle collecting container 2. The horizontal inner contour of the container receptacle 43 tapers towards the underside 115. Due to this design the container receptacle 43 is able to receive and horizontally stabilise a particle collecting container 2 with a downward-tapering outer contour.

By means of said adapter frame 51 it becomes possible to mount a particle collecting container 2, that can be stacked in an identical particle collecting container 2, on a base, in particular a suction device 79. Consequently inter-stacking—and thus easier to handle—particle collecting containers 2 can be used.

In the following, exemplary configurations of the adapter frame 51 and exemplarily assemblies comprising the adapter frame 1 are discussed, as well as their components.

As shown in FIG. 1, the adapter frame 51 has a cuboid basic design. The underside 115 is exemplarily formed by a closed adapter frame bottom, from which the adapter frame peripheral walls 83, 84, 85, 86 extend upwards, The upper side 114 of the adapter frame 51 has an open design. Exemplarily the adapter frame peripheral walls 83, 84, 85, 86 are aligned orthogonally to the adapter frame bottom. The adapter frame peripheral walls 83, 84 are aligned parallel to the longitudinal direction and are also referred to as longitudinal adapter frame peripheral walls 83, 84. The adapter frame peripheral walls 85 and 86 are aligned parallel to the transverse direction and are also referred to as transversal or frontal adapter frame peripheral walls 85, 86.

The length of the adapter frame 51 is greater than its width. Here the term width means the extension in the transversal direction. Exemplarily the width of the adapter frame 51 is greater than its height. Expediently the length of the underside 115 of the adapter frame 51 is between 350 mm and 450 mm. Preferably the width of the underside 115 of the adapter frame 51 is between 250 mm and 350 mm. In particular the length of the underside 115 of the adapter frame 51 is 396 mm and the width of the underside 115 of the adapter frame 51 is 296 mm. Preferably the height of the adapter frame 51 is at least a quarter of the length of the underside 115, in particular at least 100 mm.

On the upper side 114 of the adapter frame 51 the container receptacle 43 is provided. The container receptacle 43 exemplarily has a rectangular receiving opening 58 aligned parallel to the underside 115. The receiving opening 58 exemplarily accounts for at least 80% of the base area of the adapter frame 51. The container receptacle 43 also has a receptacle structure 117, defining the inner contour of the container receptacle 43. Exemplarily the receptacle structure 117 is configured so that the inner contour tapers continuously over the full vertical extension of the container receptacle 43. All inner sides of the container receptacle 43 contribute to the taper. Exemplarily the taper on all the inner sides of the container receptacle 43 is linear. Consequently the receptacle space provided by the container receptacle 43 corresponds to the geometry of an inverted truncated pyramid periphery. Preferably the inner sides each have substantially planar, expediently flat, surfaces.

Preferably the angles between the inner sides of the container receptacle 43 and the normal vector of the adapter frame bottom are small enough that an inserted particle collecting container 2 with cyclone pre-separator 1 positioned on it remains in the container receptacle 43 even when there is a horizontal force acting on the cyclone pre-separator 1. This is in particular also the case when the assembly of adapter frame 51, particle collecting container 2 and cyclone pre-separator 1 rests on an inclined plane with an angle of inclination of up to 10 degrees. In this case the horizontal application of force is in particular an application of force perpendicularly to the gravitational vector—and not perpendicularly to the inclined plane or to the vertical axis of the assembly. By way of example the angles to the normal vector of the adapter frame bottom are a maximum of 15 degrees, expediently a maximum of 10 degrees. Preferably the angles are less than 10 degrees. Exemplarily the angles between the lateral inner sides 122 and the normal vector of the receptacle base 44 are all the same.

Exemplarily the receptacle structure 117 also has a plurality of vertical bars 56, defining the inner contour of the container receptacle 43. The bars 56 each have a trapezoidal design and are each secured to an inner side of the peripheral walls 83, 84, 85, 86 and to an inner side of the adapter frame bottom. The bars 56 are arranged distributed over the inner sides of the peripheral walls 83, 84, 85, 86. The inward facing inner edges of the bars 56 are angled with respect to the peripheral walls 55 and/or the adapter frame bottom, so that the horizontal distance between the inner edges and the peripheral walls increases constantly towards the adapter frame bottom.

The upper side 114 of the adapter frame 51 is exemplarily formed by a frame portion 57. The frame portion 57 is secured to the peripheral walls 83, 84, 85, 86 and is aligned horizontally with its largest surface. The frame portion 57 has a frame opening, forming the receptacle opening 58. The frame portion 57 has a surrounding inner edge, forming the upper border of the container receptacle 43. At the level at which the bars 56 touch the frame portion 57, the bars 56 and the frame portion 57 are designed to be flush with each other in the horizontal direction.

Alternatively or additionally to the embodiment shown, in which the container receptacle 43 is defined by bars 56, the container receptacle 43 can also be defined by one or more closed inner walls. By way of example, all inner walls of the container receptacle 43 can be closed. The inner walls of the container receptacle 43 then in particular form the shape of an inverted truncated pyramid periphery with a rectangular base.

Figure 6:
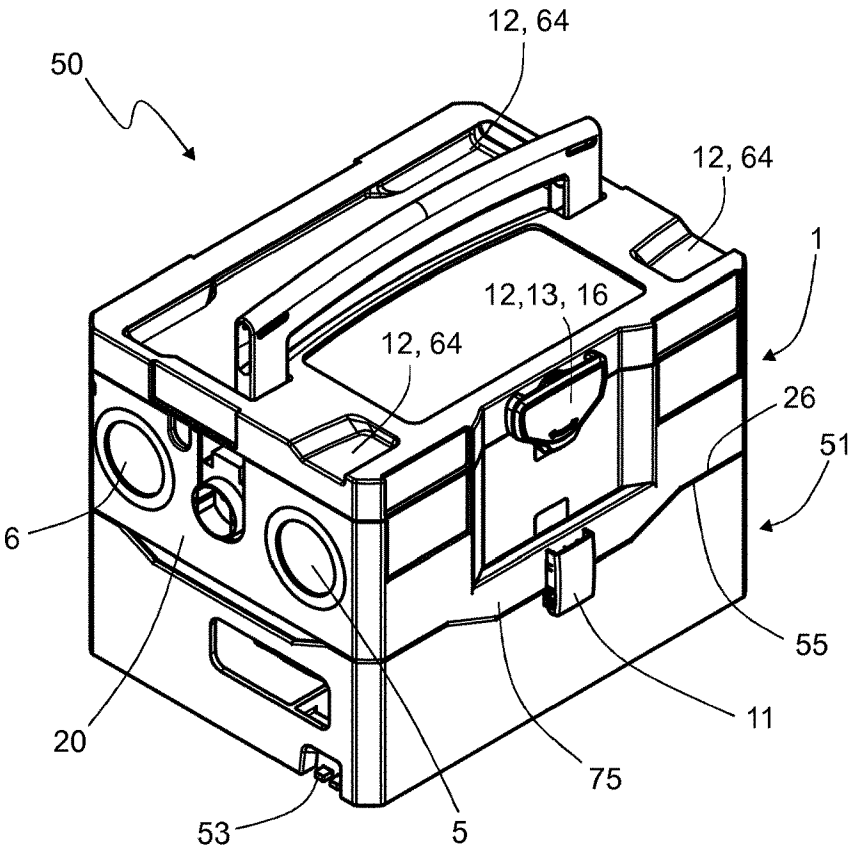
FIG. 6 shows an assembly with the cyclone pre-separator and the adapter frame.

As shown in FIG. 1, the peripheral walls 83, 84, 85, 86 protrude upwards beyond the upper side 114. The upper edges of the peripheral walls 83, 84, 85, 86 form an upper edge 55. On each peripheral wall 83, 84, 85, 86 purely exemplarily a peripheral wall indentation 87 is provided, which reduces the height of the upper edge of the respective peripheral wall 83, 84, 85, 86 relative to the other upper edge 55. The peripheral wall indentations 87 of the longitudinal peripheral walls 83, 84 are exemplarily designed to correspond with the wall sections 75 of the cyclone pre-separator 1, so that as can be seen in FIG. 6, the protruding wall sections 75 fit into these peripheral wall indentations 87.

Alternatively to this purely exemplary embodiment, the adapter frame 51 can also be designed without the peripheral wall indentations 87. By way of example the adapter frame 51 according to an embodiment not shown in the figures can have an upper edge displaced horizontally inwards in relation to the outer contour of the underside 115 of the adapter frame 51. Here the upper edge can be formed by the upper edges of the adapter frame peripheral walls 83, 84, 85, 86 or, alternatively, also be provided in addition to the adapter frame peripheral walls 83, 84, 85, 86. The upper edge surrounds the container receptacle 43 and protrudes vertically upwards over the container receptacle 43. Preferably the upper edge of the adapter frame 51 is designed to correspond with the upper edge 27 explained below of the particle collecting container 2, so that it can be inserted in the groove 25 explained in the following of the cyclone pre-separator 1. Expediently the upper edge of the adapter frame 51 has a flat design.

Preferably the adapter frame 51 has upper adapter frame couplers 52. The upper adapter frame couplers 52 serve in particular for coupling the cyclone pre-separator 1. The upper adapter frame couplers 52 are exemplarily arranged on the longitudinal peripheral walls 83, 84. Expediently the adapter frame couplers 52 are bar-shaped projections. In particular, the adapter frame couplers 52 are aligned with their longitudinal axis parallel to the longitudinal direction and preferably arranged centrally in the longitudinal direction on the longitudinal peripheral sides 83, 84. Expediently the adapter frame couplers 52 are located in the region of the upper edge of the adapter frame 51. The upper adapter frame couplers 52 are in particular arranged on the upper edge.

Figure 2:
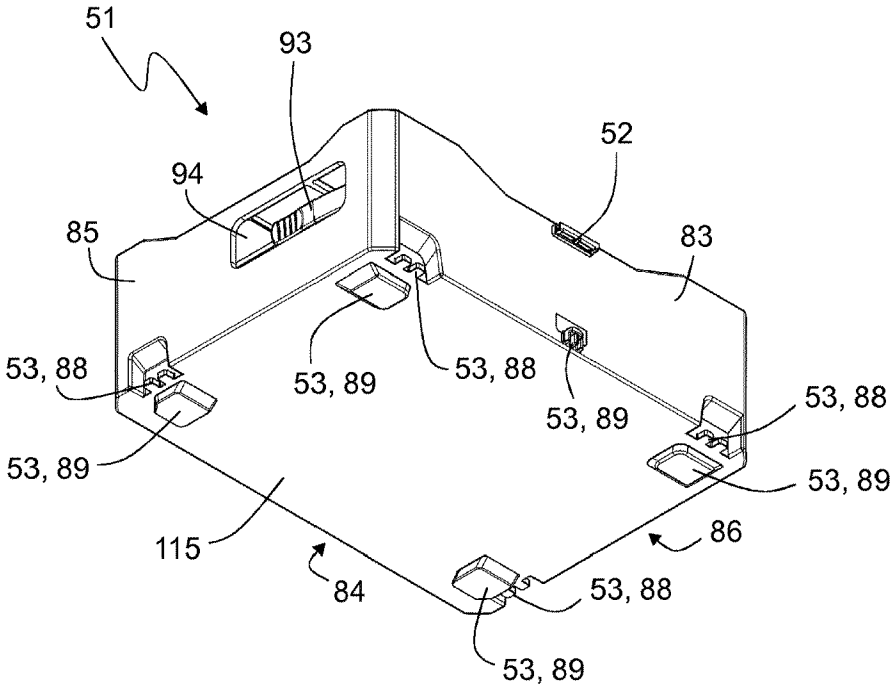
FIG. 2 shows the adapter frame from below.

FIG. 2 shows the adapter frame 51 from below. As already mentioned above, the adapter frame 51 has lower adapter frame couplers 53. The lower adapter frame couplers 53 comprise exemplarily first lower adapter frame couplers 88 and second lower adapter frame couplers 89. The first lower adapter frame couplers 88 and the second lower adapter frame couplers 89 respectively compatible with different coupling systems and/or system boxes. According to an alternative embodiment not shown in the figures, either the first lower adapter frame couplers 88 or the second lower adapter frame couplers 89 are not present.

The first lower adapter frame couplers 88 comprise exemplarily a plurality of locking projections. The locking projections are arranged on both frontal peripheral sides 85, 86 in the corner regions bordering the longitudinal peripheral side 84. The locking projections are further arranged on the longitudinal peripheral side 83, in the two corner regions bordering the frontal peripheral sides 85, 86.

The second lower adapter frame couplers 89 comprise exemplarily a locking projection, arranged in the longitudinal direction centrally on the longitudinal peripheral side 83. The second adapter frame couplers 89 exemplarily further comprise engagement projections designed as feet, arranged in the corner areas of the underside 115 of the adapter frame 51. The engagement projections and the engagement indentations 64 described below of the cyclone pre-separator 1 are designed such that when an adapter frame 51 is stacked on the cyclone pre-separator 1, the engagement projections are in a locking engagement with engagement indentations 64.

Purely exemplarily, the adapter frame 51 has operable clamping means 93, designed to clamp, in the container receptacle 43, a particle collecting container 2 inserted in the container receptacle 43. The clamping means 93 can, by way of example, comprise one or more clamping levers. The clamping levers can, by way of example, be mounted about a vertical axis. Exemplarily the clamping means 93 are arranged on the frontal peripheral sides 85, 86 on which expediently a window 94 is respectively provided in which a clamping means 93 is arranged.

Figure 3:
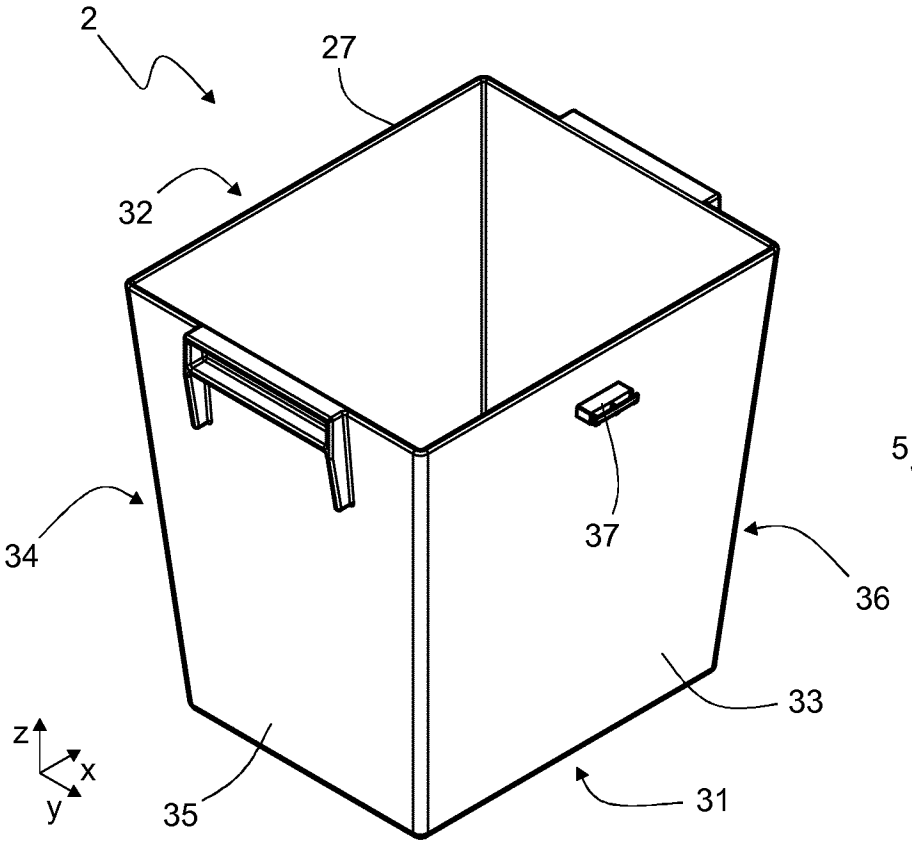
FIG. 3 shows a particle collecting container.
Figure 7:
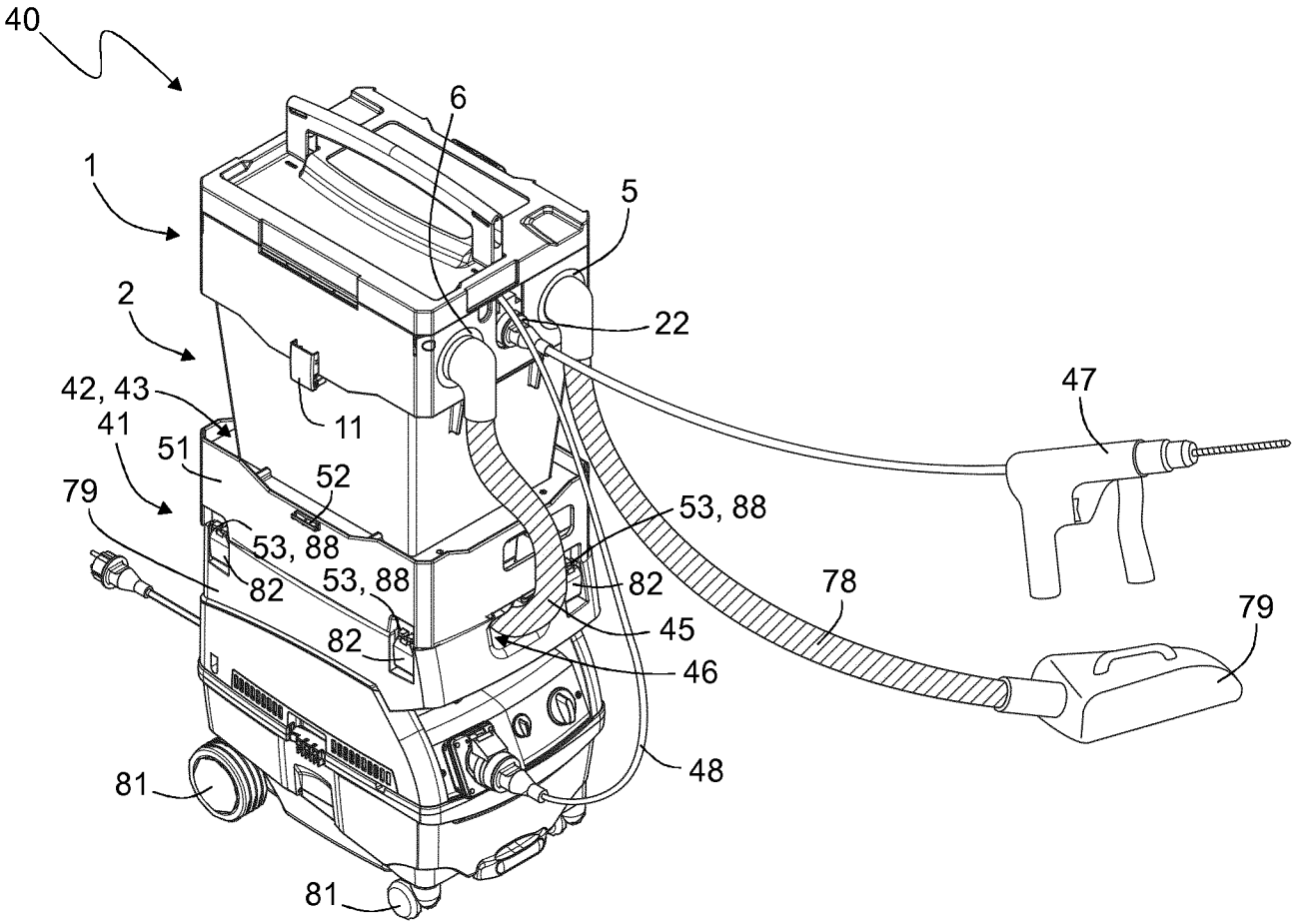
FIG. 7 shows an assembly with the cyclone pre-separator, the particle collecting container and a suction unit.

FIG. 3 shows a particle collecting container 2 which can be received and horizontally stabilised by the container receptacle 43. The particle collecting container 2 is designed as a stand structure for a cyclone pre-separator 1. FIG. 7 shows, by way of example, how the particle collecting container 2 carries the cyclone pre-separator 1. The particle collecting container 2 can be placed on a flat underlying surface. The particle collecting container 2 further has an open upper side 32, on which the cyclone pre-separator 1 can be positioned. The particle collecting container 2 has a rectangular container bottom 31 and four container peripheral walls 33, 34, 35, 36, extending upwards from the container bottom 31 and defining a horizontal outer contour of the particle collecting container 2. The horizontal outer contour defined by the container peripheral walls 33, 34, 35, 36 tapers towards the container bottom 31. The particle collecting container 2 can be stacked in an identical particle collecting container 2. The open upper side 32 is defined by the upper edge 27 of the container peripheral walls 33, 34, 35, 36.

The height of the particle collecting container 2 is exemplarily greater than its length and greater than its width. Expediently the width of the particle collecting container 2 is less than its length. Exemplarily the particle collecting container 2 has a height of 300 mm to 400 mm, preferably a height of 350 mm. The length of the particle collecting container 2 on its upper side is expediently 300 mm to 380 mm, preferably 343 mm. On its underside the length of the particle collecting container 2 is expediently 230 mm to 330 mm, preferably 283 mm. The width of the particle collecting container 2 on its upper side is expediently 230 mm to 290 mm, preferably 283 mm. On its underside the width of the particle collecting container 2 is expediently 180 mm to 260 mm, preferably 223 mm.

Exemplarily the wall planes of the four container peripheral walls 33, 34, 35, 36 are inclined away from the normal vector of the container bottom 31. Expediently the container peripheral walls 33, 34, 35, 36 together make the shape of an inverted truncated pyramid periphery.

Exemplarily the particle collecting container 2 has container couplers 37. The container couplers 37 are arranged on two longitudinal container peripheral walls 33, 34. The container couplers 37 can engage with lower housing couplers 11 of the cyclone pre-separator 1. The container couplers 37 are expediently bar-shaped protrusions. The container couplers 37 are preferably aligned with their longitudinal axis parallel to the longitudinal direction and in the longitudinal direction in particular centrally arranged on the longitudinal container peripheral walls 33, 34. The container couplers 37 are also expediently located in the region of the upper side 32 of the particle collecting container 2. Exemplarily the container couplers 37 are vertically spaced apart from the upper side 32.

Figure 4:
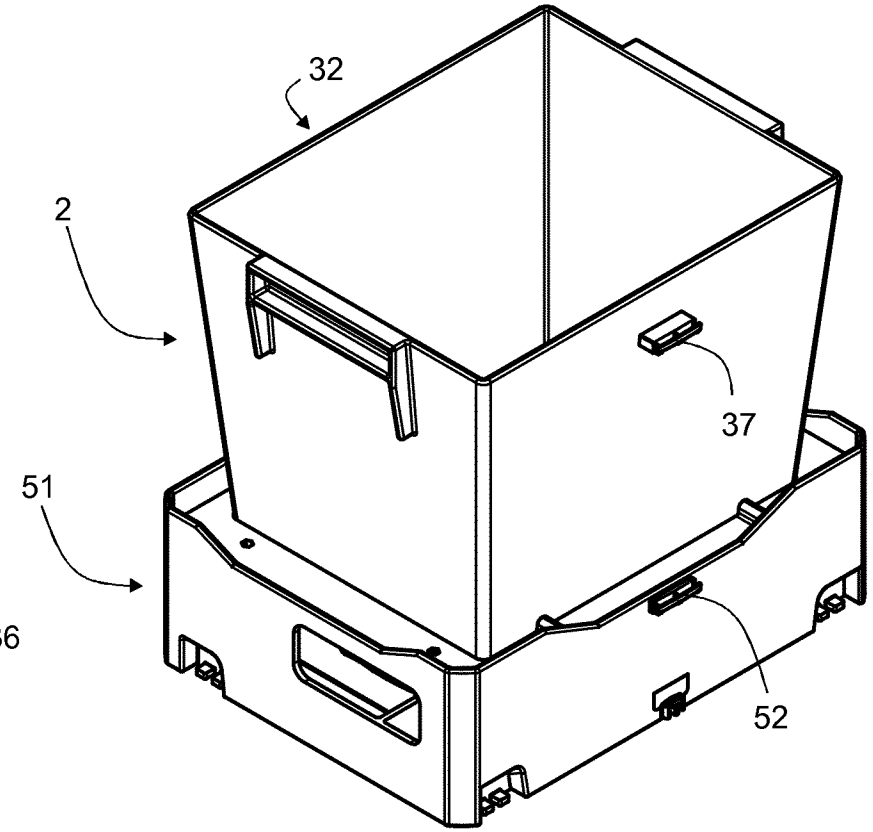
FIG. 4 shows the adapter frame with inserted particle collecting container.

FIG. 4 shows the adapter frame 51 with a particle collecting container 2 inserted in the container receptacle 43. The container receptacle 43 is designed to correspond with the portion of the particle collecting container 2 inserted in the container receptacle 43, so that the inserted portion of the particle collecting container 2 is supported laterally and from below by the adapter frame 43. In particular the container peripheral walls 33, 34, 35, 36 touch the receptacle structure 117 and the container bottom 31 rests on the adapter frame bottom. Exemplarily the particle collecting container 2 is inserted by more than one fifth, in particular by more than one quarter of its vertical extension in the container receptacle 43. Expediently the particle collecting container 2 is inserted by less than half of its vertical extension in the container receptacle 43.

The container couplers 37 and the upper adapter frame couplers 52 are expediently arranged in the longitudinal direction at the same position, so that both the upper adapter frame couplers 52 and the container couplers 37 can be coupled with one and the same lower housing couplers 11.

Figure 5:
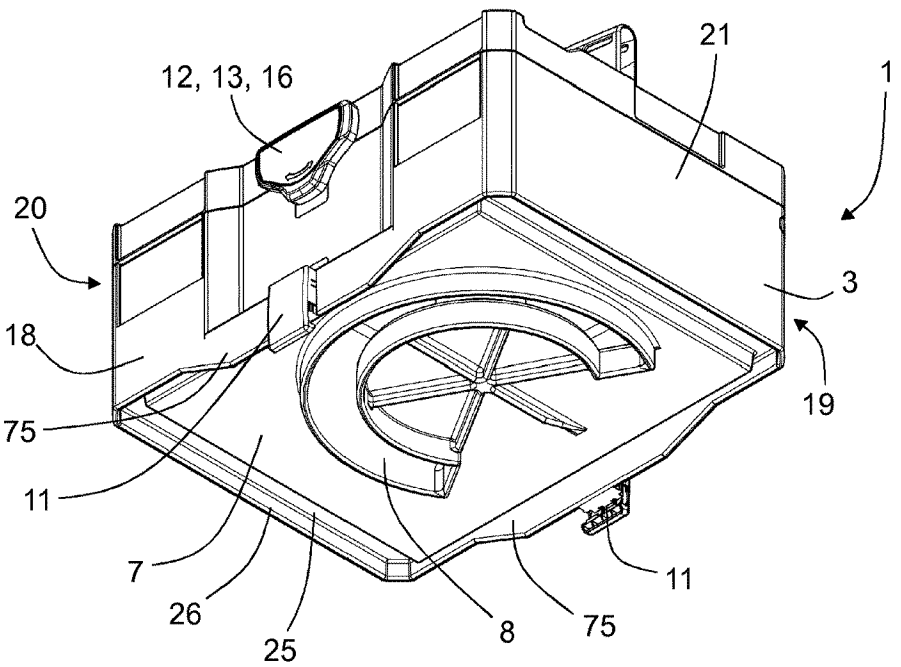
FIG. 5 shows a cyclone pre-separator from below.

FIG. 5 shows a cyclone pre-separator 1 that can be positioned on the adapter frame 51 as shown in FIG. 6.

The cyclone pre-separator 1 comprises a box-shaped housing 3. The term "box-shaped" in particular means a substantially cuboid design. "Box-shaped" further means a form where the upper side is designed so that a further box-shaped or cuboid body, in particular a system box, can be stacked on the upper side. By way of example, "box-shaped" means a form where the upper side and peripheral walls are aligned orthogonally to each other. Due to its box-shaped design, the cyclone pre-separator 1 can be accommodated and transported in a stack of further box-shaped bodies, such as by way of example system boxes. System boxes of a system have a base area defined in the system and have couplers defined in the system and/or are compatible with a particular coupling system, so that system boxes of a system can be combined to form a stable stack. System boxes are, by way of example, widely used as modular toolboxes for the storage of manually-operated power tools, accessories and/or consumables.

The height of the cyclone pre-separator 1 is exemplarily less than its width and less than its length. The horizontal dimensions of the cyclone pre-separator 1 correspond expediently to the horizontal dimensions of the underside 115 of the adapter frame 51.

The housing 3 of the cyclone pre-separator 1 has four peripheral walls 18, 19, 20, 21 aligned orthogonally to each other. The peripheral walls 18, 19 are longitudinal peripheral walls and the peripheral walls 20, 21 are frontal peripheral walls. The longitudinal peripheral walls 18 and 19 each comprise purely exemplarily a wall portion 75, protruding downwards beyond the other edge 26, arranged centrally in the longitudinal direction.

The housing 3 has lower housing couplers 11. Exemplarily the lower housing couplers 11 comprise two movably mounted locking elements and are provided on longitudinal peripheral walls 18, 19 of the housing 3. Expediently the locking elements are arranged in the longitudinal direction centrally on the longitudinal peripheral walls 18, 19. The locking elements are in particular designed as locking lugs, mounted so that they can swivel and/or slide.

On the underside 7 of the cyclone pre-separator 1 the particle outlet 8 is arranged, which exemplarily has an annular gap or annular section gap design. On the underside 7 a groove 25 is also provided, running along the outer edge 26 of the underside 7 and designed to accept the upper edge 27 of the particle collecting container 2. The groove 25 completely surrounds the particle outlet 8 and has an overall rectangular course. The outer edge 26 of the underside is exemplarily formed by the lower edge of the peripheral walls 18, 19, 20, 21.

The cyclone pre-separator 1 has an air inlet 5 and an air outlet 6, which exemplarily are arranged on the same peripheral wall, in particular on the frontal peripheral wall 20. The cyclone pre-separator 1 uses the known operating principle of a cyclone separator or of a centrifugal separator. When there is a negative pressure at the air outlet 6 an airflow is sucked in through the air inlet 5, passes through an inlet cylinder (not shown) and is output via the air outlet 6. The inlet cylinder is designed so that the airflow is directed on a circular path, wherein particles contained in the airflow are hurled against the walls of the inlet cylinder by the centrifugal force, so that they are braked and finally output from the particle outlet 8.

The housing 3 exemplarily has upper housing couplers 12, comprising a movably mounted locking element 13. The upper housing couplers 12 are designed to provide a releasable, vertically tension-proof coupling for a box-shaped body when the box-shaped body is stacked on the housing 3. The movably mounted locking element 13 is exemplarily designed as a rotary latch 16. Expediently the locking element 13 is arranged on the longitudinal peripheral side 18. The rotary latch 16 has in particular a T-shaped design.

Exemplarily the upper housing couplers 12 also have engagement indentations 64, suitable for engaging with corresponding engagement structures such as by way of example feet of a system box.

In FIG. 6 the cyclone pre-separator 1 is coupled with its lower housing couplers 11 to the upper adapter frame couplers 52 and together with the adapter frame 51 forms an assembly 50.

The assembly 50 with the upper housing couplers 12 and the lower adapter frame couplers 53 in particular has the upper and lower couplers of a system box and can therefore be handled like a system box and in particular transported and stowed in a stack of system boxes. Overall, the assembly 50 has a box-shaped, in particular cuboid, form. The upper housing couplers 12 and the lower adapter frame couplers 53 are in particular designed such that together they constitute the couplers of a system box, and thus in particular can be coupled to themselves. This means that the upper housing couplers 12 and the lower adapter frame couplers 53 are in particular designed in such a way that a body equipped with the lower adapter frame couplers 53 can be stacked and coupled releasably in a vertically tension-proof manner on a body equipped with the upper housing couplers 12.

In the exemplary embodiment of FIG. 6, the course of the upper edge 55 of the adapter frame 51 corresponds to the course of the outer edge 26 of the underside 7 of the cyclone pre-separator 1. In the cyclone pre-separator 1 shown positioned on the adapter frame 51, consequently the outer edge 26 of the underside 7 of the cyclone pre-separator 1 is arranged precisely above the upper edge 55 of the adapter frames 51 or is positioned on this.

Alternatively to this purely exemplary embodiment, the upper edge 55 of the adapter frame 51 can be inwardly displaced relative to the lower edge of the peripheral walls 83, 84, 85, 86 or relative to the lower outer contour of the adapter frame 51, so that the upper edge 55 of the adapter frame 51 can be inserted in the groove 25 of the cyclone pre-separator 1. Expediently the upper edge 55 is displaced horizontally inwards in relation to the outer edge 26.

FIG. 7 shows an assembly 40 comprising the cyclone pre-separator 1, the particle collecting container 2 and a suction unit 41. The suction unit 41 comprises a suction device 79 with suction device couplers 82 and the adapter frame 51. The adapter frame 51 is positioned on the upper side of the suction device 79 and coupled to the suction device couplers 82 via its lower adapter frame couplers 53. The lower adapter frame couplers 53 and the suction device couplers 82 provide in particular a releasable and/or vertically tension-proof coupling.

The cyclone pre-separator 1 is positioned on the particle collecting container 2 and through the lower housing couplers 11 of the cyclone pre-separator 1 and the container couplers 37 coupled in a vertically tension-proof manner to the particle collecting container 2. The particle collecting container 2 is in turn inserted in a container receptacle 43.

The suction unit 41 has a suction port 46 and is designed to provide a negative pressure at this suction port 46. The suction port 46 is connected via a hose 45 with the air outlet 6. A suction hose 78 with a suction head 79 is connected to the air inlet 5. The suction unit 41 is expediently a bag suction unit and/or a filter suction unit.

If the suction unit 41 is switched on and starts to suck, then via the suction head 79 and the suction hose 78 an airflow is sucked into the cyclone pre-separator 1. There a part of the particles present in the airflow is separated and transported to the particle collecting container 2. The airflow is output through the air outlet 6 and, via the hose 45 and the suction port 46, reaches the suction unit 41. There the airflow passes, by way of example, through a bag and/or a filter, where the particles still contained in the airflow at this point are separated. Due to the fact that a part of the particles has already been separated in the cyclone pre-separator 1, fewer particles reach the bag or filter, so that the bag or filter has to be changed less frequently.

The suction device 79 is exemplarily designed as a mobile suction device and has drive wheels 81, by which the suction device 79 is movable. The suction couplers 82 comprise at least one movably mounted locking element.

In the exemplary embodiment of FIG. 7 the adapter frame 51 with the first lower adapter frame couplers 88 is coupled to the suction device couplers 82 of the suction device 79. As already explained above, the first lower adapter frame couplers 88 comprise exemplarily a plurality of locking projections. The suction device couplers 82 comprise exemplarily movably mounted locking lugs coupled to the first lower adapter frame couplers 88.

Alternatively or additionally, the coupling can also take place via the second lower adapter frame couplers 89. In the latter case the suction device 79 can be designed such that it comprises corresponding suction device couplers that are compatible with the second lower adapter frame couplers 89. By way of example, the suction device 79 can comprise suction device couplers designed to correspond with the upper housing couplers 12 and for example comprise a movably mounted locking element, in particular a rotary latch, and engagement indentations.

The assembly 40 shown in FIG. 7 also comprises an electrical device 47, by way of example a power tool, connected to a socket 22 of the cyclone pre-separator 1. The socket 22 is in turn connected via a connecting cable 48 to the suction device 79. The suction device 79 is exemplarily designed to identify that the power tool 47 has been switched on and, in response thereto, to start sucking.

Figure 8:
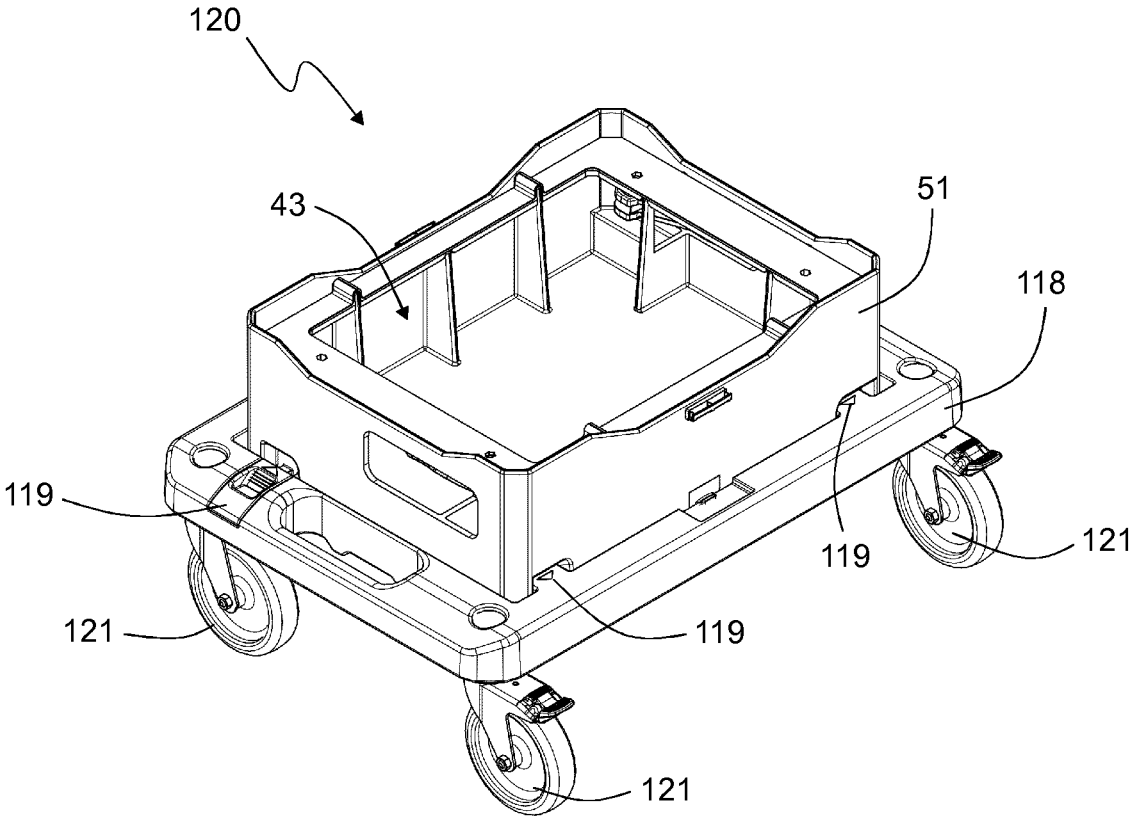
FIG. 8 shows an assembly with the adapter frame and a roller board.

FIG. 8 shows an assembly 120 of a roller board 118 and an adapter frame 51 positioned on the roller board 118. The roller board 118 has roller board couplers 119. Expediently the roller board couplers 119 comprise at least one movably mounted locking element. Exemplarily the roller board couplers comprise movably mounted locking lugs. The roller board couplers 119, in particular the locking lugs, are coupled with the lower adapter frame couplers 53, in particular the first lower adapter frame couplers 88, and provide in particular a releasable, vertically tension-proof coupling. The roller board 118 has drive wheels 121 by which the roller board 118 is movable.

According to a configuration not shown in the figures the particle collecting container 2 is inserted in the container receptacle 43 of the assembly 120. In this configuration the assembly 120 can for example be positioned on a wall, so that falling particles are caught by the particle collecting container 2.

The invention claimed is:

1. An assembly comprising:

an adapter frame for mounting onto a base and for receiving a particle collecting container for a cyclone pre-separator, wherein the adapter frame comprises:

a rectangular underside and adapter frame peripheral walls extending upwards from the underside, and lower adapter frame couplers, designed to provide a releasable, vertically tension-proof coupling to the base when the adapter frame is positioned on the base, and wherein the adapter frame on an upper side has a container receptacle for receiving the particle collecting container, a horizontal inner contour of which tapers towards the underside, so that the container receptacle is able to receive and horizontally stabilize a particle collecting container having an outer contour tapering downwards, and a box-shaped cyclone pre-separator, wherein the adapter frame has upper adapter frame couplers and the cyclone pre-separator has lower housing couplers and wherein the upper adapter frame couplers and the lower housing couplers are designed to provide a releasable, vertically tension-proof coupling between the adapter frame and the cyclone pre-separator when the assembly is in a first configuration in which the cyclone pre-separator is positioned on top the adapter frame; wherein the cyclone pre-separator comprises upper housing couplers, wherein the lower adapter frame couplers and the upper housing couplers are designed to provide a releasable, vertically tension-proof coupling between the adapter frame and the cyclone pre-separator when the assembly is in a second configuration in which the adapter frame is positioned on top the cyclone pre-separator.

2. The assembly according to claim 1, wherein the assembly further comprises a particle collecting container having container couplers, designed to provide a releasable, vertically tension-proof coupling with the lower housing couplers when the cyclone pre-separator is positioned on the particle collecting container.

3. The assembly according to claim 1, wherein a length of the underside of the adapter frame is between 350 mm and 450 mm and the width of the underside of the adapter frame is between 250 mm and 350 mm.

4. The assembly according to claim 1, wherein the inner contour of the container receptacle tapers continuously over the vertical extension of the container receptacle.

5. The assembly according to claim 1, wherein the container receptacle on an upper side accounts for at least 60% of the base area of the adapter frame.

6. The assembly according to claim 1, wherein all inner sides of the container receptacle contribute to the taper.

7. The assembly according to claim 1, wherein the adapter frame has upper adapter frame couplers, designed to provide a releasable, vertically tension-proof coupling to the cyclone pre-separator, when the cyclone pre-separator is positioned on the adapter frame.

8. The assembly according to claim 1, wherein the lower adapter frame couplers have first lower adapter frame couplers and second lower adapter frame couplers, wherein the first lower adapter frame couplers and second lower adapter frame couplers are each compatible with a different coupling system and are each designed to provide a releasable, vertically tension-proof coupling to the base.

9. The assembly according to claim 1, wherein the adapter frame has an upper edge protruding vertically upwards over the container receptacle, the upper edge surrounding the container receptacle and being displaced horizontally inwards in relation to the outer contour of the underside of the adapter frame.

10. The assembly according to claim 1, wherein the adapter frame has operable clamping means, designed to clamp in the container receptacle a particle collecting container inserted in the container receptacle.

11. The assembly according to claim 1, wherein the base is a suction device, a system box or a roller board.

12. The assembly according to claim 1, wherein the assembly has a cuboid form and is adapted to be transported and stowed in a stack of system boxes.

13. The assembly according to claim 1, wherein the box-shaped cyclone pre-separator has a housing with four peripheral walls aligned orthogonally to each other.

14. An assembly comprising a suction unit, a particle collecting container, and a cyclone pre-separator positioned on the particle collecting container, the suction unit comprising:

a suction device with suction device couplers; and an adapter frame, the adapter frame comprising:

a rectangular underside and adapter frame peripheral walls extending upwards from the underside, and lower adapter frame couplers, and wherein the adapter frame on an upper side has a container receptacle in which the particle collecting container is inserted, wherein a horizontal inner contour of the container receptacle tapers towards the underside, so that the container receptacle horizontally stabilizes the particle collecting container having an outer contour tapering downwards, wherein the adapter frame is positioned on the upper side of the suction device, and wherein the lower adapter frame couplers and the suction device couplers are coupled together to provide a releasable, vertically tension-proof coupling between the adapter frame and the suction device.

15. An assembly, comprising:

a roller board with roller board couplers; and an adapter frame positioned on the roller board, the adapter frame comprising:

a rectangular underside and adapter frame peripheral walls extending upwards from the underside, and lower adapter frame couplers, and wherein the adapter frame on an upper side has a container receptacle for receiving the particle collecting container, a horizontal inner contour of which tapers towards the underside, so that the container receptacle is able to receive and horizontally stabilize a particle collecting container having an outer contour tapering downwards, wherein the roller hoard couplers are coupled with the lower adapter frame couplers to provide a releasable vertically tension-proof coupling between the adapter frame and the roller board, wherein the assembly further comprises a particle collecting container inserted in the container receptacle and a cyclone pre-separator positioned on the particle collecting container.

* * * * *